US007955085B2

(12) United States Patent
Rotenberg et al.

(10) Patent No.: US 7,955,085 B2
(45) Date of Patent: Jun. 7, 2011

(54) MOUNTING BRACKET FOR TRAILER WIRING CONNECTOR

(75) Inventors: Gregory Rotenberg, Highland Heights, OH (US); Jerry Corless, Streetsboro, OH (US)

(73) Assignee: Cequent Consumer Products, Solon, OH (US)

( * ) Notice: Subject to any disclaimer, the term of this patent is extended or adjusted under 35 U.S.C. 154(b) by 0 days.

(21) Appl. No.: 12/633,191

(22) Filed: Dec. 8, 2009

(65) Prior Publication Data

US 2010/0144197 A1 Jun. 10, 2010

Related U.S. Application Data

(60) Provisional application No. 60/201,193, filed on Dec. 8, 2008.

(51) Int. Cl.
*H01R 33/00* (2006.01)

(52) U.S. Cl. ..... 439/35; 439/731; 439/906; 439/521

(58) Field of Classification Search ..... 439/731, 439/906, 34, 35, 521
See application file for complete search history.

(56) References Cited

U.S. PATENT DOCUMENTS

| | | | | |
|---|---|---|---|---|
| 4,629,268 | A | 12/1986 | Hiles | |
| 5,001,300 | A * | 3/1991 | Messelhi | 174/87 |
| 5,288,094 | A | 2/1994 | Putnam | |
| 5,380,209 | A | 1/1995 | Converse, Jr. et al. | |
| 5,407,219 | A * | 4/1995 | Chiu | 280/422 |
| 5,611,695 | A | 3/1997 | Bentley | |
| 5,722,854 | A | 3/1998 | Geisler | |
| 5,732,966 | A | 3/1998 | Menard et al. | |
| 5,816,824 | A | 10/1998 | White et al. | |
| 5,931,706 | A * | 8/1999 | Bassi | 439/731 |
| 6,019,386 | A | 2/2000 | Morelock | |
| 6,076,691 | A | 6/2000 | Belinky et al. | |
| 6,080,014 | A | 6/2000 | Steiler | |
| 6,089,907 | A | 7/2000 | Shoblom | |
| 6,685,502 | B2 | 2/2004 | Wheeler | |
| 6,887,098 | B1 * | 5/2005 | Luo et al. | 439/540.1 |
| 6,971,883 | B1 | 12/2005 | Ridge | |
| 7,037,133 | B2 | 5/2006 | Matsuo | |
| D530,676 | S | 10/2006 | Schemm et al. | |
| 7,168,956 | B2 | 1/2007 | Charnesky | |
| 7,455,524 | B1 | 11/2008 | Fudala et al. | |
| 2005/0037632 | A1 * | 2/2005 | Ihde | 439/35 |

* cited by examiner

*Primary Examiner* — Tho D Ta
(74) *Attorney, Agent, or Firm* — McDonald Hopkins LLC

(57) ABSTRACT

A mounting bracket for a trailer wiring connector is described. The mounting bracket may attach the electrical connector to a cross bar of a towing vehicle. The mounting bracket may include an upper housing and a lower housing. The upper housing may include a mounting aperture and a plurality of slots. The lower housing may include a threaded aperture and a plurality of tabs. The tabs may be capable of engagement with the slots to secure the upper housing to the lower housing. The lower housing may also include a clamping fastener, such as a set screw, that may be capable of engagement with a threaded aperture, wherein the set screw may be capable of clamping engagement with the electrical connector. The mounting bracket may also include a cover capable of engagement with the electrical connector.

26 Claims, 9 Drawing Sheets

MOUNTING BRACKET FOR TRAILER WIRING CONNECTOR

CROSS-REFERENCE TO RELATED APPLICATION

This application claims benefit from U.S. Provisional Patent Application No. 61/201,193, entitled "Mounting Bracket for Trailer Wiring Connector," filed on Dec. 8, 2008, which is hereby incorporated by reference in its entirety.

FIELD OF THE INVENTION

The present invention relates generally to mounting brackets and, more particularly, to mounting brackets for trailer wiring connectors.

BACKGROUND

Towed vehicles or trailers are commonly coupled to towing vehicles to facilitate the transfer of items or objects, such as vehicles, boats, cargo, and the like. When a trailer is coupled to a towing vehicle, the trailer may commonly obscure the taillights and rear turn signals of the towing vehicle such that other motorists and pedestrians cannot readily observe the taillights and turn signals of the towing vehicle. Such a situation may present dangerous driving conditions for the drivers of the towing vehicles as well as drivers of other vehicles driving near a towing vehicle.

To alleviate such a dangerous situation, trailers may commonly be equipped with taillights and turn signals that are visible to surrounding motorists and pedestrians. To ensure that the taillights and turn signals of the trailer behave in accordance with the taillights and turn signals of the towing vehicle, the electrical system of the trailer may be coupled to the electrical system of the towing vehicle. In such an arrangement, the taillights of the trailer may illuminate when the driver of the towing vehicle applies the brakes, the turn signals of the trailer illuminate when the driver of the towing vehicle engages the turn signal, etc.

To facilitate the coupling of the trailer electrical system to the towing vehicle electrical system, it is common to utilize electrical connectors. Typically, one such connector may be secured to the towing vehicle and one such connector may be coupled to the trailer. Each electrical connector often includes multiple terminals, pins, sockets, or the like. The terminals, pins, and sockets may often be arranged to be mated so that the connector of the trailer may be coupled to the connector of the towing vehicle. Such a coupling will relay electrical signals from the towing vehicle to the lights positioned on the trailer.

When the trailer is not properly coupled to the towing vehicle, the electrical connector secured to the towing vehicle may freely hang from a rear portion of the towing vehicle. In such a condition, the terminals, pins, or sockets of the electrical connector may be exposed to a number of conditions that may cause damage or other such deterioration of the electrical connector. For example, the electrical connector may drag along the ground while the towing vehicle is driven, resulting in damage to the electrical connector due to abrasions, friction, impact with the ground, and other such wear and tear. In addition, the electrical connector may be exposed to the elements such as dust, debris, rain, snow, salt, and the like. Such exposure may lead to physical damage, corrosion, or other such deleterious effects to the electrical connector, particularly the terminals, pins, and sockets of the connector.

SUMMARY

A mounting bracket for a trailer wiring connector is described. The mounting bracket may attach the electrical connector to a cross bar of a towing vehicle. The mounting bracket may include an upper housing and a lower housing. The upper housing may include a mounting aperture and a plurality of slots. The lower housing may include a threaded aperture and a plurality of tabs. The tabs may be capable of engagement with the slots to secure the upper housing to the lower housing. The lower housing may also include a set screw that may be capable of engagement with a threaded aperture, wherein the set screw may be capable of clamping engagement with the electrical connector. The mounting bracket may also include a cover capable of engagement with the electrical connector.

A method of securing an electrical connector to a towing vehicle is described. The method may include the steps of placing the electrical connector within an inner chamber located between an upper housing and a lower housing and snapping the upper housing and the lower housing together around the electrical connector. Next, the upper housing and the lower housing may be secured together via at least one fastener and then a clamping fastener may be tightened through a threaded aperture located in the lower housing to tighten the electrical connector within the inner chamber. The mounting bracket may then be secured to a cross bar of the towing vehicle.

BRIEF DESCRIPTION OF THE DRAWINGS

Objects and advantages together with the operation of the invention may be better understood by reference to the detailed description taken in connection with the following illustrations, wherein:

FIG. 1OF illustrates a top perspective view of the lower housing of FIG. 10A.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

Mounting brackets for electrical connectors to be used with towing vehicles and towed vehicles may be arranged to secure the electrical connector to the towing vehicle or towed vehicle or trailer such that the electrical connector may be positioned above the ground thereby avoiding contact with the ground. The mounting bracket may also reduce or eliminate wear and tear, corrosion, and other such damage to the electrical connector. In addition, mounting brackets may be arranged to shield an electrical connector from the elements, such as dust, debris, rain, snow, salt, and the like.

Figure 5:
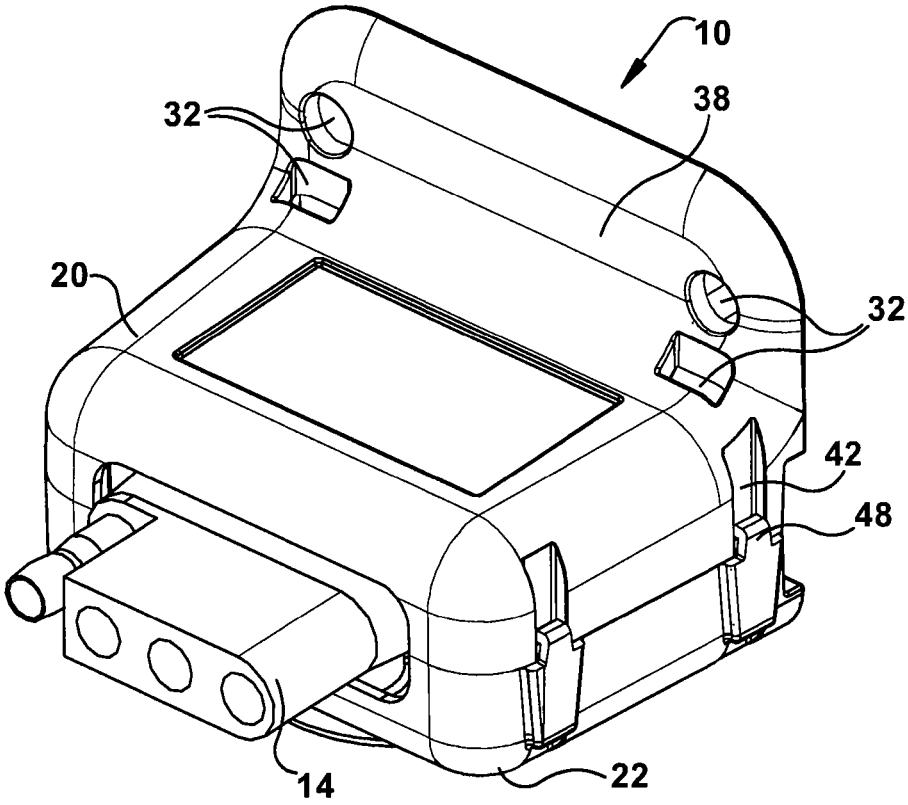
FIG. 5 illustrates a front perspective view of a mounting bracket with an electrical connector secured within the mounting bracket.

A mounting bracket 10 for an electrical connector 14 is illustrated in FIGS. 1-4. The mounting bracket 10 may include an inner chamber 12 to accommodate at least a portion of an electrical connector 14 whereby the electrical connector 14 may be secured relative to the mounting bracket 10. The electrical connector 14 may be partially positioned within the inner chamber 12 of the bracket 10 whereby a portion of the connector 14 may extend through an opening in a front face of the bracket 10 (FIG. 5). The electrical connector 14 may be of any appropriate shape, size or type, such as a 4-way flat connector. In addition, the electrical connector 14 may include any appropriate number, shape or type of terminals, pins, sockets or the like.

Figure 7:
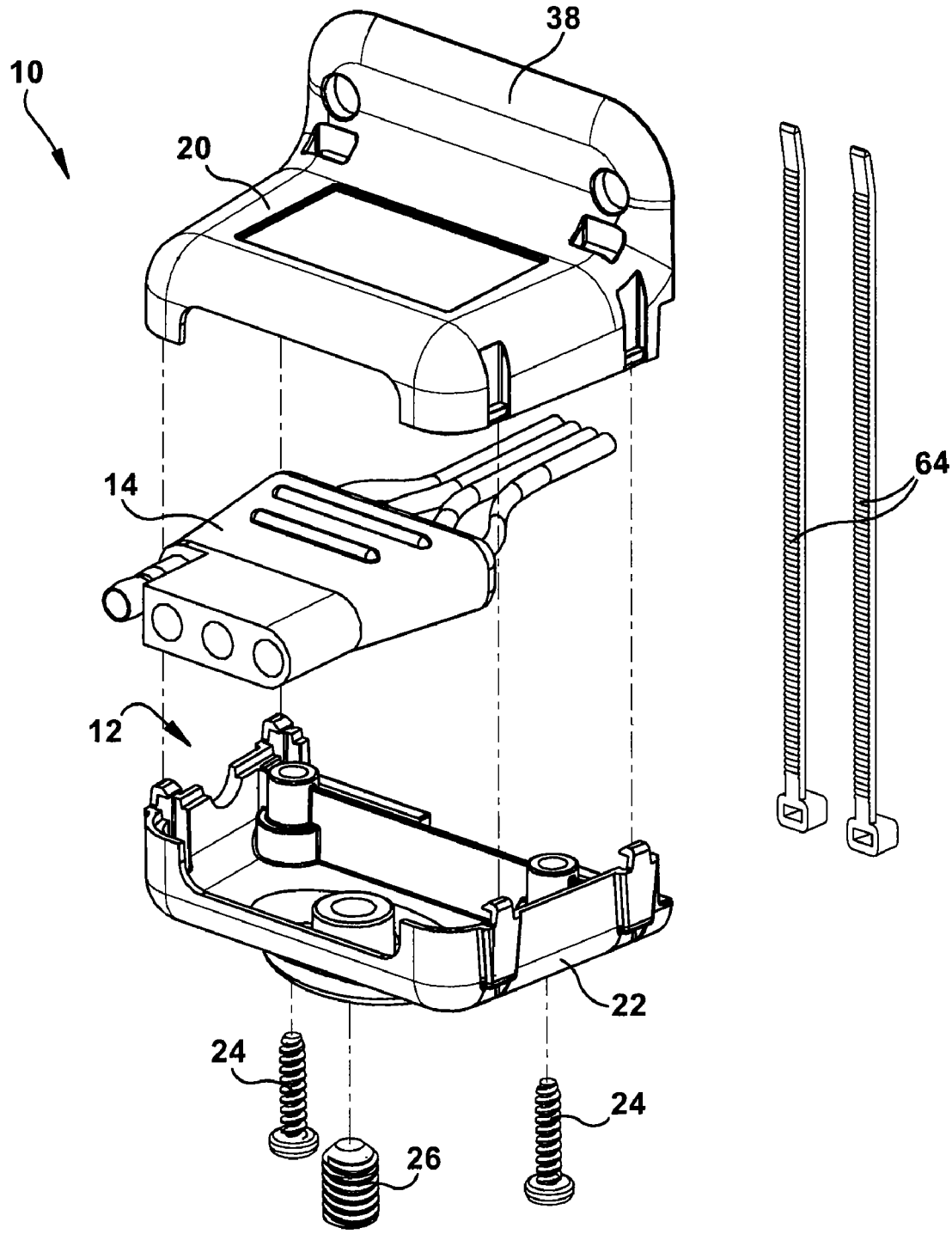
FIG. 7 illustrates an exploded view of a mounting bracket and an electrical connector.

The mounting bracket 10 may be arranged as a multi-component system (FIG. 7). The bracket 10 may include an upper housing 20 and a lower housing 22. The upper housing 20 and lower housing 22 may be assembled and secured together by any appropriate means, such as by fasteners, ties or the like. The upper 20 and lower 22 housings may be of any appropriate shape or size, such as a generally square or rectangular shape. For example, the upper 20 and lower 22 housings may be of a generally corresponding shape and size. The upper 20 and lower 22 housings may be fabricated out of any appropriate material. For example, the upper 20 and lower 22 housings may be fabricated from high impact plastic. A mounting bracket 10 fabricated from high impact plastic may yield a compact design that is generally resistant to corrosion.

The upper housing 20 and lower housing 22 may each include a recessed area that mate to form the inner chamber 12 of the mounting bracket 10. The inner chamber 12 may be of any appropriate shape or size, such as being shaped and sized to secure the electrical connector 14 there between. The electrical connector 14 may be positioned between the upper 20 and lower 22 housings prior to the housings 20, 22 being snapped or attached together, as well as prior to any fasteners 24 being utilized to secure the housings 20, 22 together. For example, at least a portion of the electrical connector 14 may be secured within the assembled mounting bracket 10. The portion of the electrical connector 14 secured may be a harness. After the harness is secured within the bracket 10, the harness may generally be protected from dust, debris, rain, snow, salt, and the like.

Figure 8A:
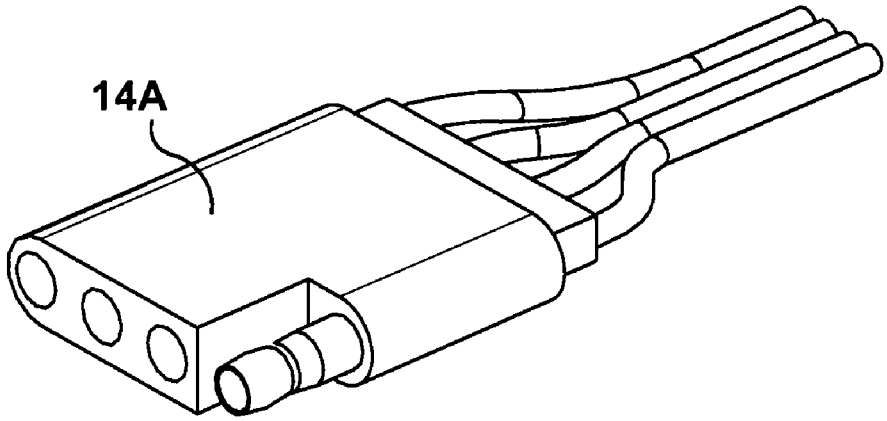
FIG. 8A illustrates a perspective view of an electrical connector.
Figure 8B:
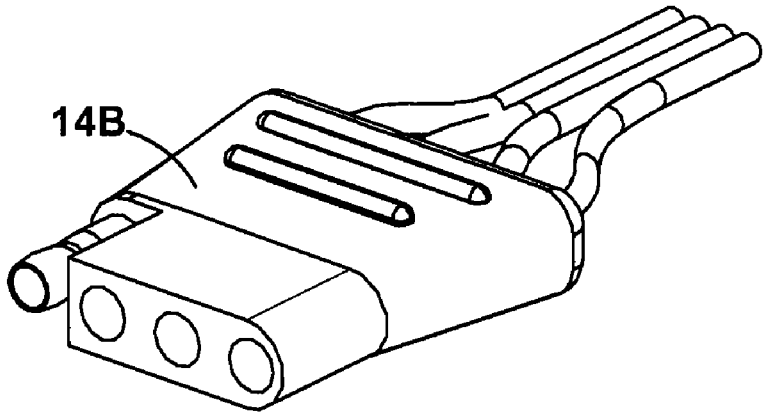
FIG. 8B illustrates a perspective view of an electrical connector.
Figure 8C:
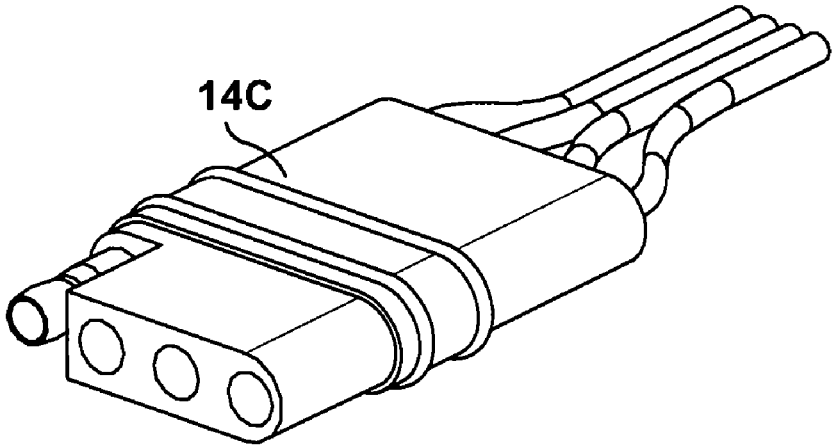
FIG. 8C illustrates a perspective view of an electrical connector.

The inner chamber 12 of the mounting bracket 10 may be arranged so that it may accommodate a variety of shaped and sized electrical connectors 14. The electrical connectors, such as 14A, 14B, 14C, may be similar, have generally identical terminal, pin, and socket arrangements, or may have uniquely shaped harnesses or bodies (FIGS. 8A-8C). The harnesses of the electrical connector 14 may include different heights, widths, and lengths.

The inner chamber 12 of the mounting bracket 10 may be shaped to accommodate all types of electrical connectors 14A, 14B, 14C (FIGS. 8A-8C), along with many more styles or designs of electrical connectors not shown. For example, the mounting bracket 10 may be arranged to accommodate a variety of four-way flat connectors. To further facilitate the accommodation of a variety of electrical connectors, the mounting bracket 10 may be arranged with a clamping fastener, such as a set screw 26 (FIG. 7).

The upper housing 20 of the mounting bracket 10 is illustrated in FIGS. 9A-9E. The upper housing 20 may include a series of teeth 30, a series of apertures 32, a flange 38, a plurality of slots 42, and at least one projection 44. The lower housing 22 of the mounting bracket 10 is illustrated in FIGS. 10A-10F. The lower housing 22 may include at least one aperture 34, a threaded aperture 28, an alignment wall 46, a plurality of tabs 48, and a series of apertures 36.

Figure 9A:
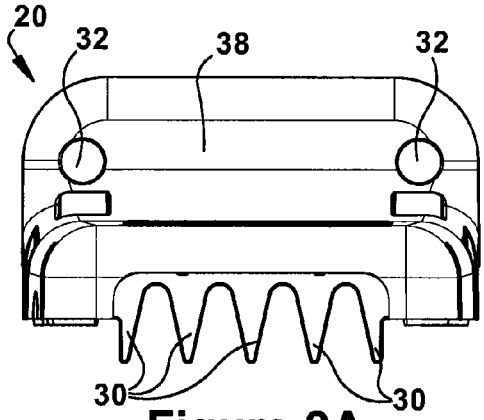
FIG. 9A illustrates a front view of an upper housing for a mounting bracket.
Figure 9B:
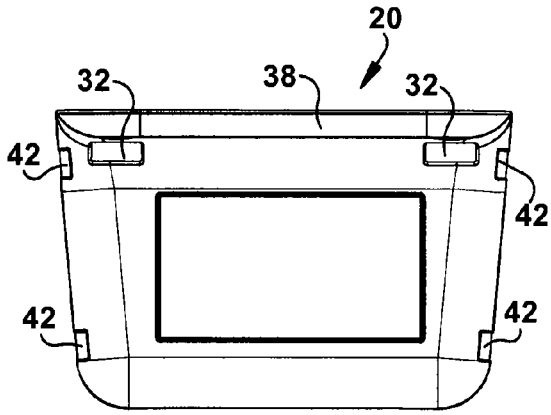
FIG. 9B illustrates a top view of the upper housing of FIG. 9A.
Figure 9C:
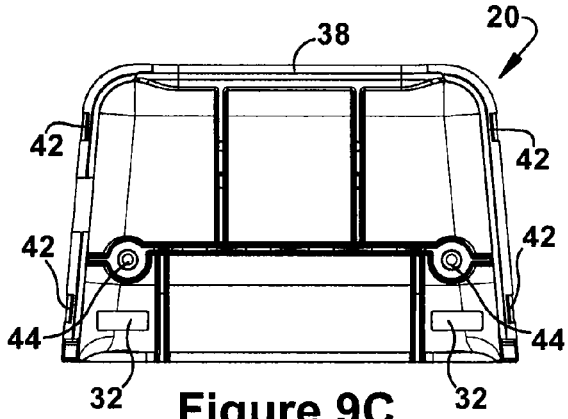
FIG. 9C illustrates a bottom view of the upper housing of FIG. 9A.
Figure 9D:
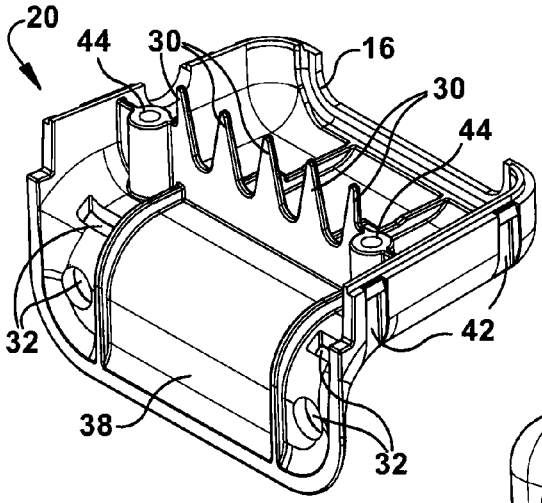
FIG. 9D illustrates a bottom perspective view of the upper housing of FIG. 9A.

The upper housing 20 may include a series of teeth 30 (FIGS. 9A and 9D). There may be any appropriate number of teeth 30. The teeth 30 may be of any appropriate shape or size, such as of a generally triangular shape. The teeth 30 may be located at any appropriate position on the upper housing 20. The lower housing 22 may include an alignment wall 46. The alignment wall 46 may be of any appropriate shape or size, such as a generally rectangular shape that may extend the width of the lower housing 22. The alignment wall 46 may be located at any appropriate position on the lower housing 22, such as at a location generally opposite that of the series of teeth 30 of the upper housing 20. When the upper housing 20 and lower housing 22 are joined together, the generally pointed ends of the teeth 30 may be engaged with or may be positioned proximate to the alignment wall 46 of the lower housing 22.

Figure 3:
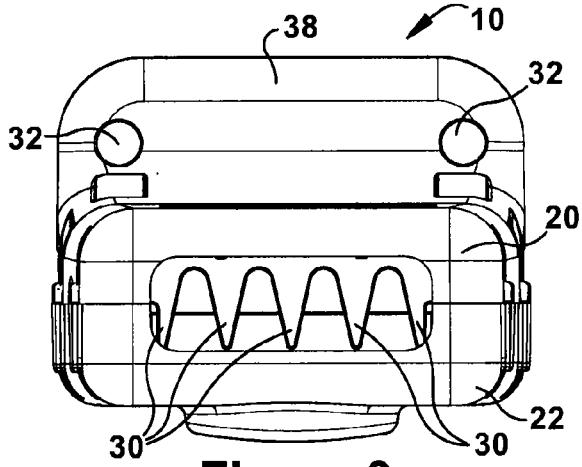
FIG. 3 illustrates a front view of the mounting bracket.
Figure 4:
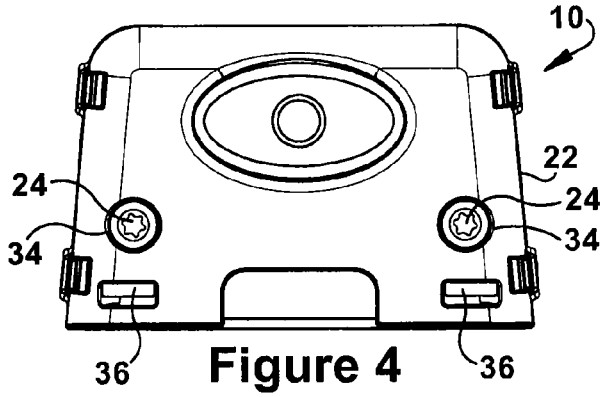
FIG. 4 illustrates a bottom view of the mounting bracket.
Figure 6:
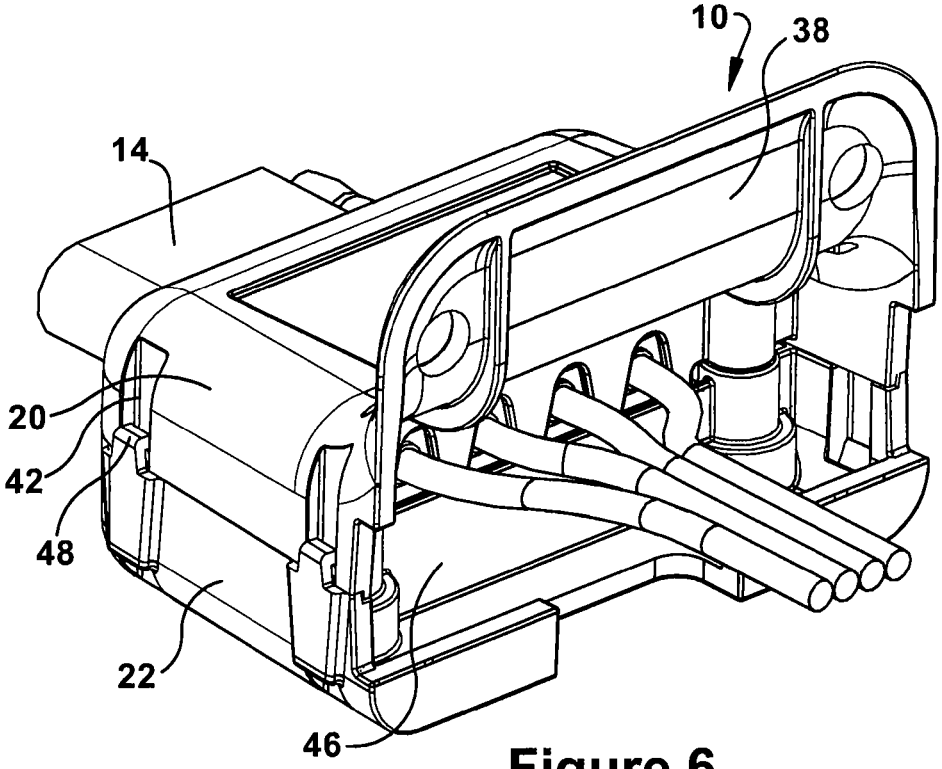
FIG. 6 illustrates rear perspective view of the mounting bracket with the electrical connector of FIG. 5.

The engagement of the teeth 30 with the alignment wall 46 of the lower housing 22 may form channels there between that may separate and guide the wiring that may run from the electrical connector 14 to the towing vehicle electrical system (see FIGS. 3 and 6). Such separation of the wiring prevents entanglement or other potential problems that may occur with the wiring. In addition, the teeth 30 may allow the wiring of the electrical connector 14 to pass through the back of the mounting bracket 10 while physically restraining the harness of the electrical connector 14 to further secure the connector 14 within the mounting bracket 10.

Figure 9E:
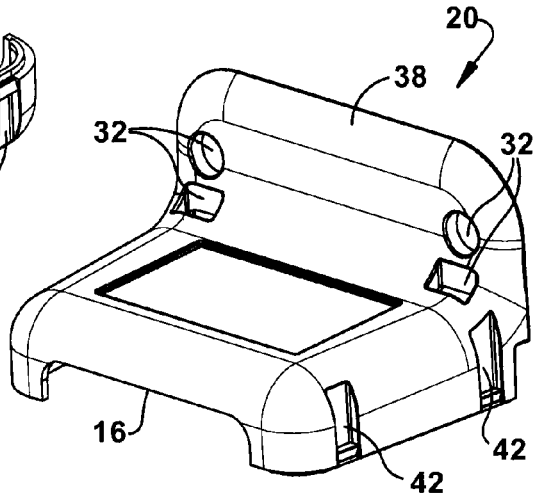
FIG. 9E illustrates a top perspective view of the upper housing of FIG. 9A.

The upper housing 20 may include a flange 38. The flange 38 may be located at any appropriate position on the upper housing 20, such as toward the rear of the upper housing 20. The flange 38 may be of any appropriate shape or size, such as a generally rectangular or square shape. The flange 38 may extend substantially perpendicularly and outwardly from an upper surface of the upper housing 20 (FIG. 9A and 9E). The flange 38 may aid in attachment of the mounting bracket 10 to the hitch receiver 62 (FIGS. 12-16)

The upper 20 and lower 22 housings may be arranged such that the housings 20, 22 may each have at least one feature designed whereby the housings 20, 22 may attach or snap together to form the mounting bracket 10. The upper housing 20 may include a plurality of slots 42 (FIGS. 9B-9E). There may be any appropriate number of slots 42. The slots 42 may be of any appropriate shape or size, such as of a generally rectangular or square shape. The slots 42 may be located at any appropriate position on the upper housing 20, such as along the sides of the upper housing 20.

The lower housing 22 may include a plurality of tabs 48 (FIGS. 10C-10F). The tabs 48 may be of any appropriate shape or size, such as a generally rectangular, square or hooked shape. The tabs 48 may be located at any appropriate position on the lower housing 22, such as along the sides of the lower housing 22. For example, the tabs 48 may be positioned at a location generally opposite that of the plurality of slots 42 of the upper housing 20. When the upper housing 20 and lower housing 22 are placed together, the plurality of slots 42 may engage with the plurality of tabs 48 of the lower housing 22, thereby snapping or attaching the housings 20, 22 together.

While the housings 20, 22 are shown as having four slots 42 and tabs 48, it is to be understood that any appropriate number of slots 42 and tabs 48 may be utilized and should not be limited to that shown and described herein. In addition, while the mounting bracket 10 is shown as utilizing a snapping arrangement to secure the upper 20 and lower 22 housings together, it is to be understood that any other appropriate type of attachment means may be utilized and should not be limited to that shown or described herein.

The housings 20, 22 may also be arranged so that at least one fastener 24 may be utilized to secure the housings 20, 22 together to form the mounting bracket 10 (FIG. 7). The upper 20 and lower 22 housings may be arranged so that a fastener 24, such as a screw or bolt, may pass through an aperture in the lower housing 22 and be threadedly secured in the upper housing 22, thereby securing the housings 20, 22 together.

The upper housing 20 may include a plurality or series of apertures 32 that may be utilized to secure the mounting bracket 10 to the towing vehicle (FIGS. 9A-9E). There may be any appropriate number of apertures 32 in the upper housing 20. The apertures 32 may be of any appropriate shape or size, such as of a generally circular, rectangular or square shape. The apertures 32 may be located at any appropriate position on the upper housing 20, such as to aid in attachment of the mounting bracket 10 to the hitch receiver 62 of the towing vehicle. For example, the apertures 32 may be located on the flange 38, upper portion or sides of the upper housing 20.

Similar to the upper housing 20, the lower housing 22 also may include a plurality or series of apertures 36 that may be utilized to secure the mounting bracket 10 to the towing vehicle. The lower housing 22 may include any appropriate number of apertures 36. The apertures 36 may be of any appropriate shape or size, such as of a generally circular, square or rectangular shape. The apertures 36 may be located at any appropriate position on the lower housing 22, such as to aid in attachment of the mounting bracket 10 to the hitch receiver 62 of the towing vehicle. For example, the apertures 36 may be located on the bottom portion or sides of the lower housing 22.

The lower housing 22 may include a threaded aperture 28 through which a clamping fasteners, such as a set screw 26, may be inserted to further secure the electrical connector 14 within the mounting bracket 10. The threaded aperture 28 may match the threads of the set screw 26. The threaded aperture 28 may be of any appropriate shape or size, such as a generally circular shape. The threaded aperture 28 may be positioned at any appropriate location on the lower housing 22, such as adjacent the front end (FIG. 10A).

Figure 10A:
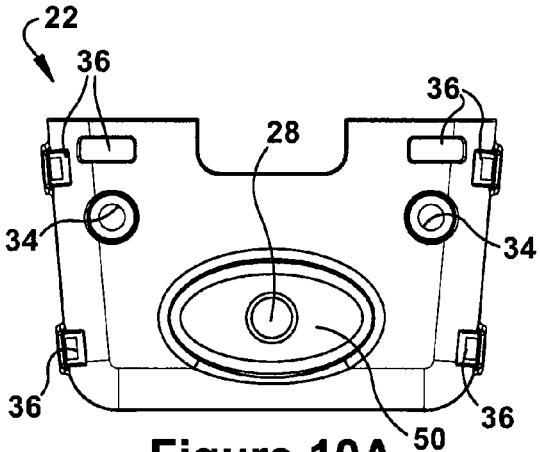
FIG. 10A illustrates a bottom view of a lower housing for a mounting bracket.
Figure 10B:
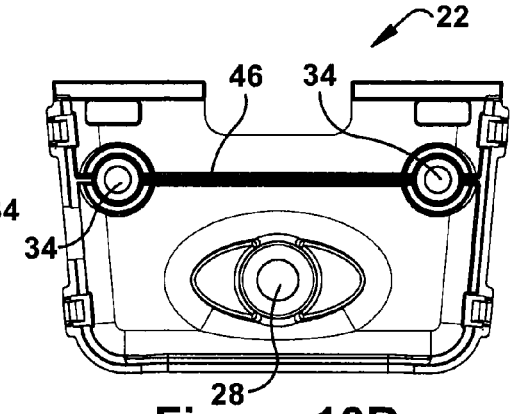
FIG. 10B illustrates a top view of the lower housing of FIG. 10A.
Figure 10C:
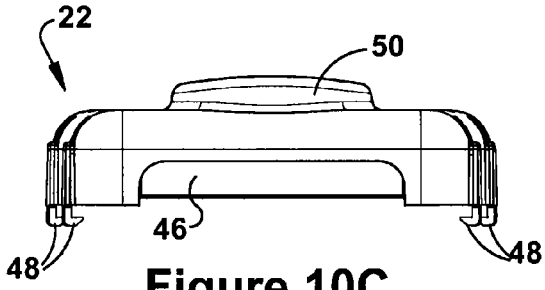
FIG. 10C illustrates a front view of the lower housing of FIG. 10A.
Figure 10D:
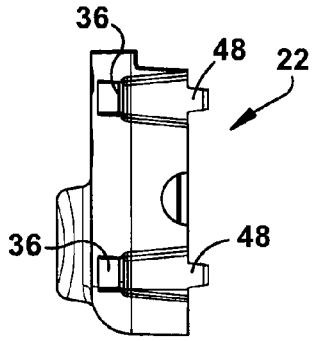
FIG. 10D illustrates a side view of the lower housing of FIG. 10A.
Figure 10E:
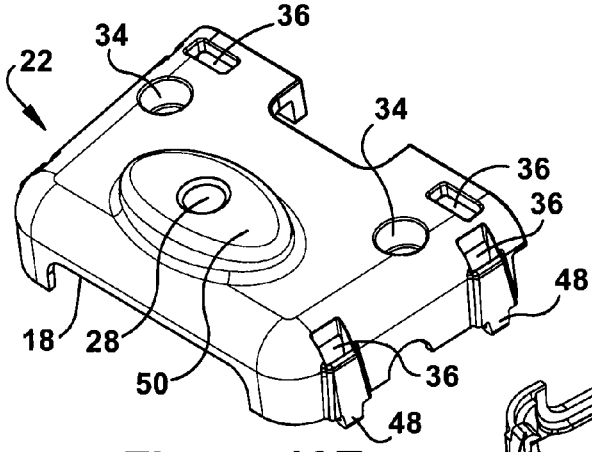
FIG. 10E illustrates a bottom perspective view of the lower housing of FIG. 10A.

The lower housing 22 may also include a platform 50 (FIGS. 10A and 10C-10E). The platform 50 may be of any appropriate shape or size, such as a generally circular, rectangular or ovular shape. The platform 50 may be located at any appropriate position on the lower housing 22. For example, the platform 50 may be located adjacent the front end and may extend perpendicularly outward from the bottom surface of the lower housing 22. The threaded aperture 28 may be located at the approximate center of the platform 50 (FIG. 10A).

Once the electrical connector 14 is placed between the housings 20, 22 and the housings 20, 22 are secured together, the set screw 26 may be threaded into the threaded aperture 28 whereby the set screw 26 may engage the harness of the electrical connector 14. Once the set screw 26 is engaged with the threaded aperture 28, the set screw 26 may be tightened to remove any slack or gap between a wall of the inner chamber 12 and the electrical connector 14, resulting in a well-fitted positioning of the electrical connector 14 within the mounting bracket 10. It is to be understood that the set screw 26 and threaded aperture 28 as described may be incorporated into the upper housing 20, or the upper housing 20 and the lower housing 22 may each include a set screw and a threaded aperture, and should not be limited to that shown or described herein.

The upper housing 20 may include at least one projection 44 (FIGS. 9C and 9D). The upper housing 20 may include any appropriate number of projection 44, such as two, three or four. The projection 44 may be of any appropriate shape or size, such as of a generally cylindrical, circular, square or rectangular shape. The projections 44 may be located at any appropriate position on the upper housing 20, such as on the upper portion of the upper housing 20.

The lower housing 22 may include at least one aperture 34 (FIGS. 10A, 10B, 10E and 10F). The lower housing 22 may include any appropriate number of apertures 34, such as two, three or four. The apertures 34 may be of any appropriate shape or size, such as of a generally cylindrical, circular, square or rectangular shape. The apertures 34 may be located at any appropriate position on the lower housing 22, such as on the bottom portion of the lower housing 22. For example, the apertures 34 may be positioned at a location generally opposite that of the projections 44 of the upper housing 20, whereby the projections 44 may abut the apertures 34 when the upper 20 and lower 22 housings are attached together. In addition, the apertures 34 may accommodate fasteners 24 that may aid in securing the upper 20 and lower 22 housings together.

Figure 1:
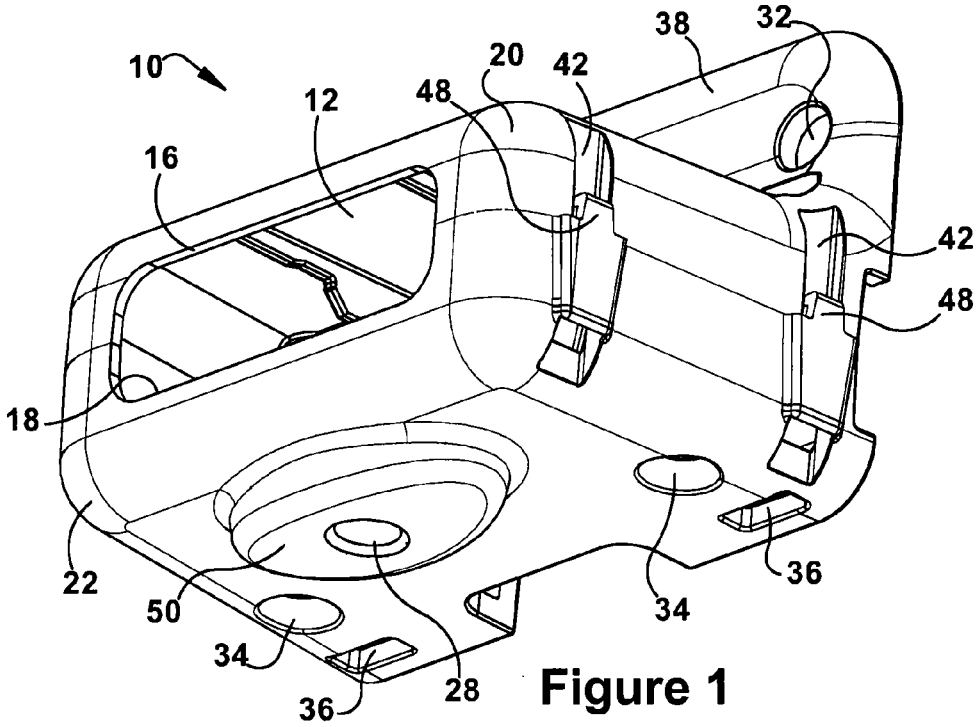
FIG. 1 illustrates a perspective view of a mounting bracket.
Figure 2:
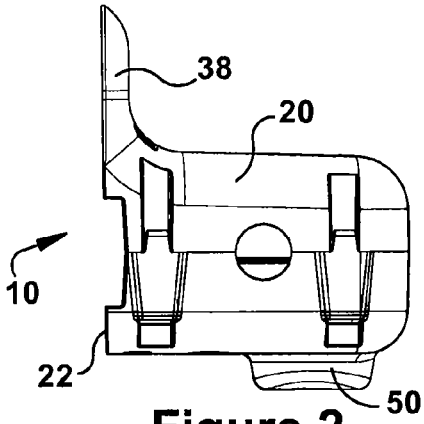
FIG. 2 illustrates a side view of the mounting bracket.

The upper housing 20 may include a cutout or opening 16. The lower housing 22 may include a cutout or opening 18. These openings 16, 18 may be of any appropriate shape or size, such as a generally rectangular, square or circular shape. These openings 16, 18 may also be of a generally corresponding shape and size. When the upper 20 and lower 22 housings of the mounting bracket 10 are attached together, the openings 16, 18 form one larger opening located near the mounting brackets 10 front face that may lead into the inner chamber 12 (FIGS. 1 and 5).

Figure 15:
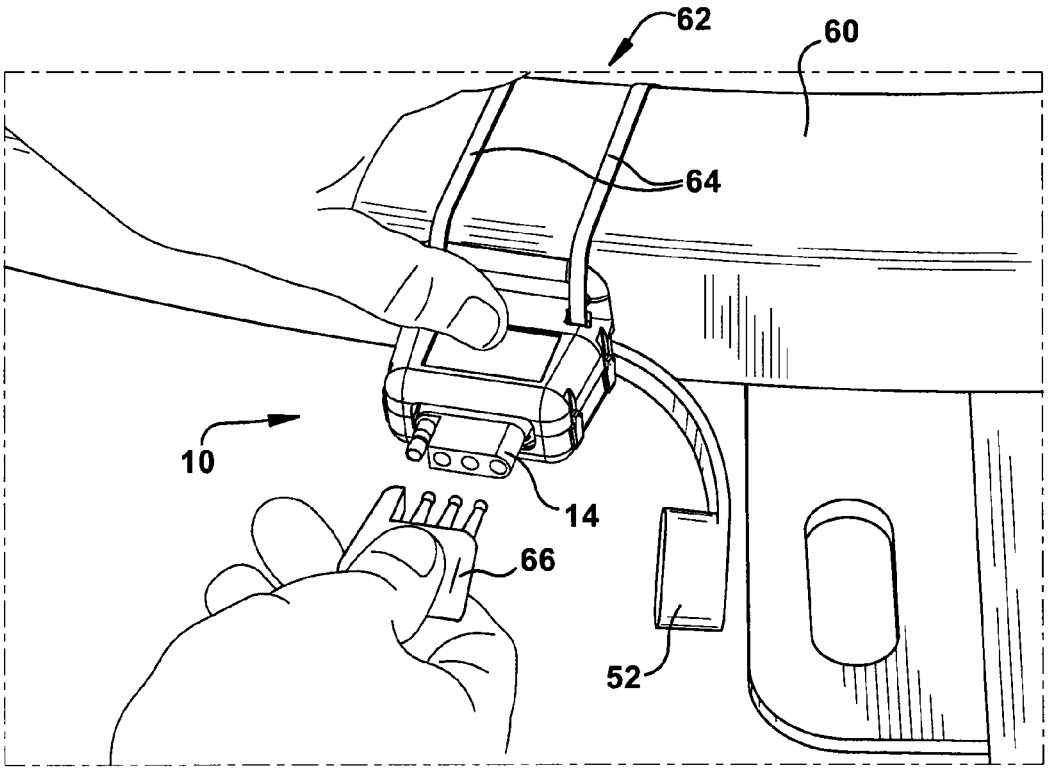
FIG. 15 illustrates a perspective view of a mounting bracket secured to the receiver of a towing vehicle.
Figure 16:
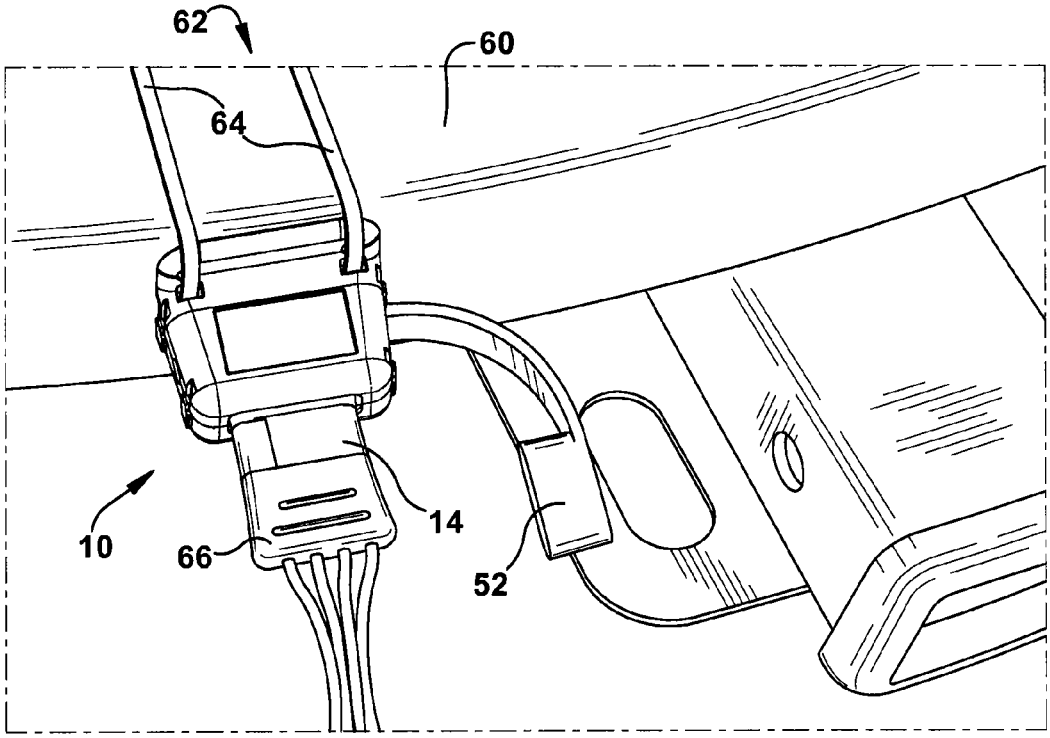
FIG. 16 illustrates a perspective view of a mounting bracket secured to the receiver of a towing vehicle.

This larger opening of the mounting bracket 10 may allow a portion of the electrical connector 14 and the terminals, pins, or sockets of the electrical connector 14 to extend through the front face of the bracket 10 (FIG. 5). In such an arrangement, the terminals, pins, or sockets may be mated with matching terminals, pins, or sockets of an electrical connector 66 that may be secured to a trailer, thereby placing the towing vehicle electrical system in electrical communication with the trailer electrical system (FIGS. 15 and 16). There may be another opening in the rear of the mounting bracket 10 that may allow for wiring to extend out of the back of the bracket 10 and to the towing vehicle electrical system (FIG. 6).

The two-part design of the mounting bracket 10 may eliminate any need to disconnect existing wires extending from the towing vehicle electrical system when the electrical connector 14 is being secured to the towing vehicle. The harness portion of the connector 14 may be placed into the bracket 10 while accommodating the wiring connecting the towing vehicle electrical system to the electrical connector 14.

Figure 11:
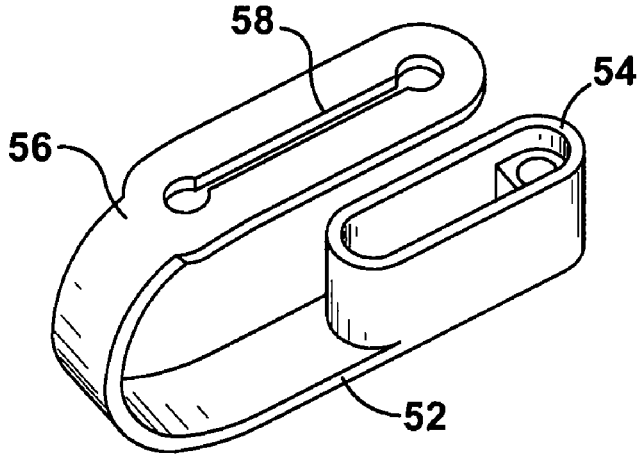
FIG. 11 illustrates a perspective view of a cover for a mounting bracket.
Figure 13:
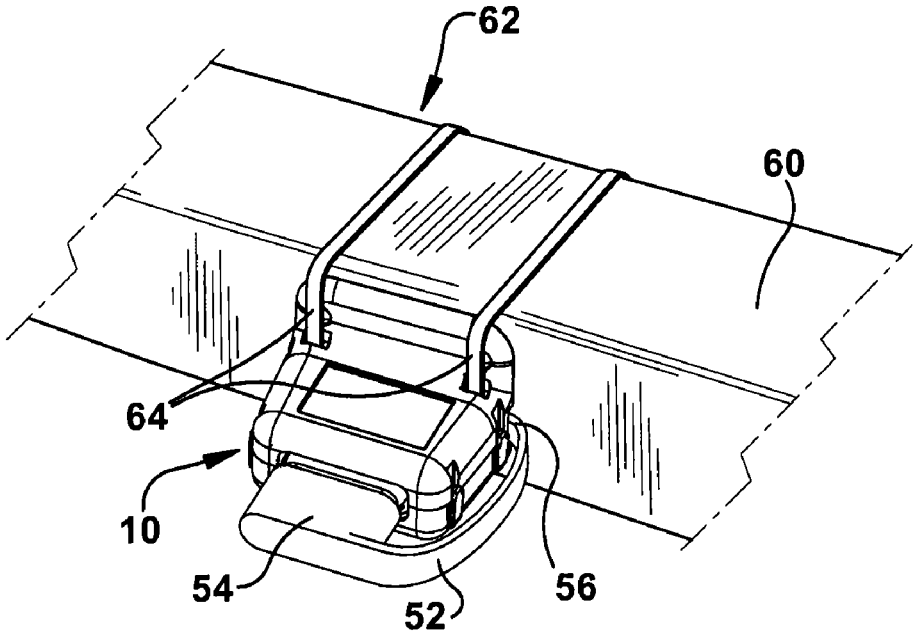
FIG. 13 illustrates a perspective view of a mounting bracket secured to the receiver of a towing vehicle.
Figure 14:
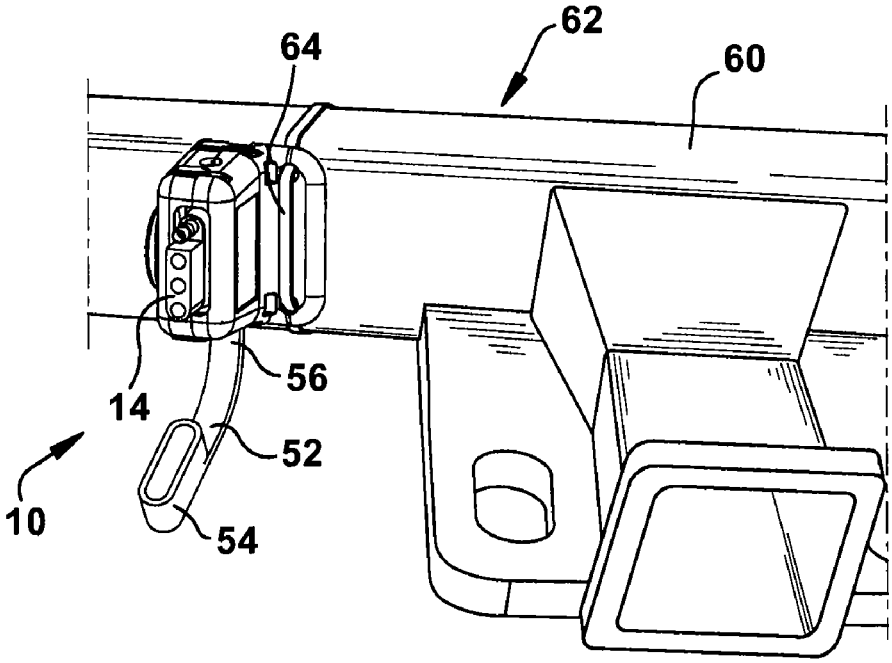
FIG. 14 illustrates a perspective view of a mounting bracket secured to the receiver of a towing vehicle.

The mounting bracket 10 may utilize a cover 52 (FIGS. 11, 13 and 14). The cover 52 may protect the terminals, pins, and sockets of the electrical connector 14 from dust, moisture, salt, and other such corrosive and destructive containments. The cover 52 may include a cap portion 54, a strap portion 56, and a slot 58 (FIG. 11). The cap portion 54 may be of any appropriate shape or size, such as a generally ovular or rectangular shape. For example, the cap portion 54 may be arranged to snuggly fit over the terminals, pins, and sockets of the electrical connector 14, whereby the terminals, pins, and sockets may be shielded from contaminants while the electrical connector 14 is secured to the towing vehicle but not yet coupled to the trailer's electrical system.

The slot 58 of the strap portion 56 may permit the wiring of the electrical connector 14 to pass through the cover 52 and to secure the cover 52 from falling from the towing vehicle. In such an arrangement, the cover 52 may remain secured to the towing vehicle regardless whether it is engaged with the terminals, pins, and sockets. The cover 52 may be fabricated from any variety of appropriate materials. For example, the cover 52 may be fabricated from an elastomeric rubber.

Figure 12:
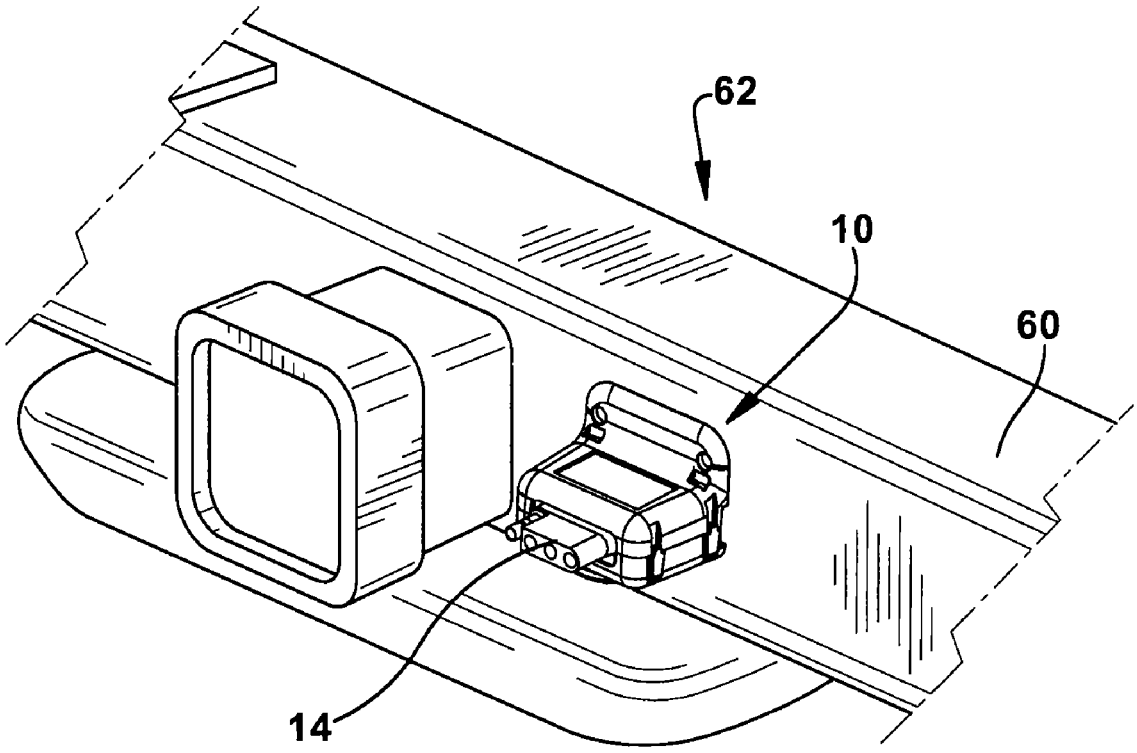
FIG. 12 illustrates a perspective view of a mounting bracket secured to a receiver of a towing vehicle.

Various arrangements for securing the mounting bracket 10 to a towing vehicle are illustrated in FIGS. 12-16. The mounting bracket 10 may be secured to the towing vehicle at any appropriate location or position and by any appropriate means. For example, the mounting bracket 10 may be secured to a cross tube 60 of a hitch receiver 62 (FIG. 12). The hitch receiver 62 is a common component used to secure a trailer to a towing vehicle and may typically be secured to the rear of a towing vehicle. The mounting bracket 10 may be arranged to be selectively secured to a variety of types of hitch receivers. For example, the mounting bracket 10 may be arranged to be secured to the cross tube of a Class I, II, III, IV, or V receiver.

The mounting bracket 10 may be secured to a cross tube 60 of the hitch receiver 62 by utilizing the apertures 32, 36 in the upper 20 and lower 22 housings of the bracket 10 (FIGS. 13-16). The mounting bracket 10 may be attached to the cross tube 60 of the hitch receiver 62 by any appropriate means, such as with fasteners, straps or the like. Fasteners may be passed through the apertures 32 and secured to the cross tube 60 through any number of methods. For example, straps 64 such as cable ties may be used to secure mounting bracket 10 to the cross tube 60. In addition, the mounting bracket 10 may be secured to the cross tube 60 at any appropriate location on the cross tube 60.

The use of cable ties 64 may eliminate the need for drilling or otherwise permanently altering the cross tube 60. The cable ties 64 may be of any appropriate shape, length or size. The cable ties 64 may be fabricated from any variety of appropriate materials. For example, the cable ties 64 may be fabricated from a non-elastomeric polymer so that the overall length of the cable tie 64 does not change when subjected to a tensile force. In another example, the cable ties 64 may be fabricated from a polymer that is capable of withstanding the rigors of exposure to harsh weather and other such elements.

The mounting bracket 10 may be secured to a cross tube 60 by passing a cable ties 64 through apertures 32, 36 in the upper 20 and lower 22 housings (FIGS. 13 and 14). For example, the cable tie 64 may be passed through an aperture 32 in the upper housing 20, then the cable tie 64 may be positioned around the cross tube 60, and the cable tie 64 may then be passed through an aperture 36 in the lower housing 22 to complete the attachment of the bracket 10 to the cross tube 60.

The mounting bracket 10 may be secured to a cross tube 60 in a horizontal arrangement (FIG. 13), or the mounting bracket 10 may be secured to a cross tube 60 in a vertical arrangement (FIG. 14). The cover 52 may be positioned over the terminals, pins, and sockets of the electrical connector 14, and the cover 52 may be removed from the terminals, pins, and sockets of the electrical connector 14, but still remain secured to the towing vehicle through its engagement with the wiring of the electrical connector 14 (FIGS. 13 -16).

The electrical connector 14 may be secured to the towing vehicle by the mounting bracket 10. Once secured, the electrical connector 14 may be coupled to the electrical system of the trailer (FIGS. 15 and 16). When the cover 52 is removed from the terminals, pins, and sockets of the electrical connector 14, the connector 14 may be manually coupled to the electrical system of the trailer by way of a trailer electrical connector 66 (FIGS. 15 and 16).

Although mounting brackets 10 have been generally described and illustrated herein as attached or secured to a towing vehicle, it will be readily understood that a mounting bracket may be arranged to be attached or secured to a trailer. A mounting bracket arranged to be secured to a trailer may utilized the same or similar methods and apparatus as that described for attachment to a towing vehicle.

Although the preferred embodiment has been illustrated in the accompanying drawings and described in the foregoing detailed description, it is to be understood that the present application or claims are not to be limited to just the preferred embodiment disclosed, but that the disclosed apparatus and methods are capable of numerous rearrangements, modifications and substitutions without departing from the scope of the claims hereafter.

Having thus described the invention, we claim:

1. A mounting bracket for securing an electrical connector~the mounting bracket comprising:

a first housing comprising at least one mounting aperture, at least one slot, a series of teeth, and at least one projection;

a second housing comprising at least one tab capable of engagement with said at least one slot, a wall capable of engagement with said series of teeth, and at least one attachment aperture capable of engagement with said at least one projection;

wherein, when attached, said first housing and said second housing define an inner chamber capable of securing the electrical connector; and wherein the engagement of said teeth with said wall provides at least one opening capable of separating wires of the electrical connector.

2. The mounting bracket of claim 1, wherein an attachment fastener is capable of engagement with said attachment apertures and said projections to secure said first housing and said second housing together.

3. The mounting bracket of claim 1, wherein said mounting bracket is capable of being secured to the towing vehicle via said mounting apertures of said first housing.

4. The mounting bracket of claim 1, wherein said mounting bracket is capable of being mounted vertically or horizontally.

5. The mounting bracket of claim 1, wherein said inner chamber is shaped and sized for receiving a 4-way flat connector.

6. The mounting bracket of claim 1, wherein said structure of a towing vehicle is a cross-bar.

7. The mounting bracket of claim 1, wherein said structure of a towing vehicle is a bumper.

8. The mounting bracket of claim 1, wherein said second housing has a pair of attachment apertures and said wall expands between said attachment apertures.

9. The mounting bracket of claim 8, wherein said first housing has a pairs of projections and said series of teeth expands between said projections.

10. The mounting bracket of claim 1, wherein said first housing includes a cutout for receiving a portion of the electrical connector.

11. The mounting bracket of claim 10, wherein said second housing includes a cutout for receiving a portion of the electrical connector.

12. The mounting bracket of claim 11 further including a cover that is capable of engagement with the electrical connector that is partially extended out of said mounting bracket via said cutouts.

13. The mounting bracket of claim 1 further including a threaded aperture located in said second housing.

14. The mounting bracket of claim 13, wherein said threaded aperture is capable of engagement with a clamping fastener that is capable of engagement with the electrical connector.

15. A mounting bracket for securing an electrical connector comprising:

an first housing including a flange, wherein said flange includes at least one mounting aperture;

a plurality of slots located on said first housing, wherein said first housing includes a plurality of teeth;

a second housing including a threaded aperture, wherein said second housing includes a wall capable of engagement with said plurality of said teeth;

a plurality of tabs located on said second housing, wherein said plurality of tabs are capable of engagement with said plurality of slots;

a clamping fastener capable of engagement with said threaded aperture, wherein said clamping fastener is capable of clamping engagement with the electrical connector; a cover capable of engagement with the electrical connector;

wherein said mounting bracket is capable of being connected to a cross bar of a towing vehicle using the mounting aperture; and wherein the engagement of said teeth with said wall provides at least one opening capable of separating wires of the electrical connector.

16. The mounting bracket of claim 15, wherein said threaded aperture is located in a platform on the second housing.

17. The mounting bracket of claim 15, wherein said mounting bracket is capable of being used on Class I, II, III, IV, or V hitch receivers.

18. The mounting bracket of claim 15, wherein said mounting bracket is capable of being mounted vertically or horizontally on the cross bar of the hitch receiver.

19. A method of securing an electrical connector to a towing vehicle, said method comprising:

placing the electrical connector within a recessed area of one of a first housing and a second housing, wherein said first housing includes a plurality of teeth and said second housing includes a wall capable of engagement with said plurality of said teeth;

attaching said first housing and said second housing together to form a mounting bracket, the electrical connector being disposed within an inner chamber of said mounting bracket and wherein the engagement of said plurality of teeth with said wall provides at least one opening capable of separating wires of the electrical connector;

securing said first housing and said second housing together via at least one fastener; and securing said mounting bracket to a cross bar of the towing vehicle.

20. The method of claim 19, wherein said mounting bracket is secured to the cross bar by at least one cable tie.

21. The method of claim 19, wherein the step of securing the electrical connector within said inner chamber includes tightening a clamping fastener through a threaded aperture located in said second housing.

22. A mounting bracket comprising:

a first housing comprising at least one mounting aperture, at least one slot, a series of teeth, and at least one projection;

a second housing connected to said first housing, said second housing comprising at least one tab capable of engagement with said at least one slot, a wall capable of engagement with said series of teeth, and at least one attachment aperture capable of engagement with said at least one projection;

an inner chamber defined by an interior portion of said first housing and said second housing;

an electrical connector positioned within said inner chamber, wherein said electrical connector includes wiring connections of a towing vehicle; and wherein the engagement of said teeth with said wall provides at least one opening for separating wires of the electrical connector.

23. The mounting bracket of claim 22 further comprising a threaded aperture located in said second housing.

24. The mounting bracket of claim 22, wherein said threaded aperture is capable of engagement with a clamping fastener that is capable of engagement with said electrical connector.

25. The mounting bracket of claim 22, wherein said mounting bracket is mounted to a structure of a towing vehicle.

26. The mounting bracket of claim 25, wherein said structure of a towing vehicle is a cross bar.

* * * * *

UNITED STATES PATENT AND TRADEMARK OFFICE

CERTIFICATE OF CORRECTION

PATENT NO. : 7,955,085 B2
APPLICATION NO. : 12/633191
DATED : June 7, 2011
INVENTOR(S) : Gregory Rotenberg et al.

It is certified that error appears in the above-identified patent and that said Letters Patent is hereby corrected as shown below:

On the Title page, Item (60) delete "Provisional application no. 60/201,193, filed on Dec. 8, 2008." and insert --Provisional application no. 61/201,193, filed on Dec. 8, 2008.--

Figure 10F:
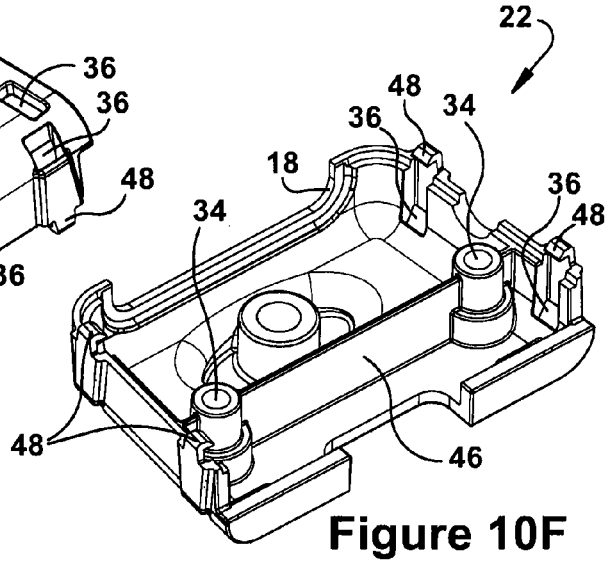

Column 3, line 7, delete "FIG. 1OF" and insert --FIG. 10F--

Signed and Sealed this
Twenty-seventh Day of November, 2012

David J. Kappos

David J. Kappos
*Director of the United States Patent and Trademark Office*